US005327632A

United States Patent [19]

Moore

[11] Patent Number: 5,327,632

[45] Date of Patent: Jul. 12, 1994

[54] PICK PROOF DEADBOLT CONVERSION KIT

[76] Inventor: Orel R. Moore, 1162 Riverside Dr., Myrtle Creek, Oreg. 97457

[21] Appl. No.: 136,935

[22] Filed: Oct. 18, 1993

Related U.S. Application Data

[63] Continuation-in-part of Ser. No. 050,992, Apr. 22, 1993, which is a continuation of Ser. No. 872,318, Apr. 23, 1992, abandoned.

[51] Int. Cl.[5] ..... E05B 13/08

[52] U.S. Cl. ..... 29/401.1; 70/93; 70/416; 292/150

[58] Field of Search ..... 70/416, 467, 468, 483, 70/93, 211, 429, 430; 292/150, 359, 288, 289, 264; 29/401.1

[56] References Cited

U.S. PATENT DOCUMENTS

| | | | |
|---|---|---|---|
| 999,127 | 7/1911 | Slivenick | 292/149 |
| 4,482,177 | 11/1984 | Nagy | 292/264 X |
| 4,590,777 | 5/1986 | Sierra | 70/104 |
| 5,000,498 | 3/1991 | Upchurch | 292/288 |
| 5,003,803 | 4/1991 | Richards | 70/416 |
| 5,052,202 | 10/1991 | Murphy | 70/211 |

FOREIGN PATENT DOCUMENTS

| | | | |
|---|---|---|---|
| 234780 | 7/1961 | Australia | 70/93 |
| 1913643 | 3/1969 | Fed. Rep. of Germany | 70/93 |
| 185383 | 10/1936 | Switzerland . | |
| 1564607 | 4/1980 | United Kingdom | 292/359 |

*Primary Examiner*—Lloyd A. Gall
*Attorney, Agent, or Firm*—Richard C. Litman

[57] ABSTRACT

A conversion kit allows a user to convert a conventional deadbolt lock mechanism into a pick proof deadbolt lock mechanism by providing all the necessary parts allowing a user to easily and effectively prevent the turnpiece latch of the deadbolt lock mechanism from rotating. Once installed, a locking shaft pin of the kit can be placed into a first orifice drilled through the turnpiece latch and a second orifice, coaxially aligned with the first orifice, drilled through the backplate to immobilize the turnpiece latch in its locked position. It would also allow a deadbolt manufacturer to use the same, in which case the collars could be a rivet style.

6 Claims, 6 Drawing Sheets

PICK PROOF DEADBOLT CONVERSION KIT

CROSS REFERENCE TO RELATED APPLICATIONS

This application is a continuation-in-part of Ser. No. 08/050,992, filed Apr. 22, 1993, which is a continuation of Ser. No. 07/872,318, filed Apr. 23, 1992, and now abandoned.

BACKGROUND OF THE INVENTION

1. Field of the Invention

The present invention primarily relates to single cylinder deadbolt locks installed on the doors of homes having the advantage of allowing a user inside the home to physically engage the latch with the backplate thereof when the deadbolt is latched, thereby preventing any would be intruder from entering the home by picking the lock. More particularly, the present invention pertains to a kit for modifying a conventional single cylinder deadbolt lock found in most homes in order to provide the above mentioned advantage lacking in most conventional single cylinder deadbolt locks. However, the same function may be applied at the manufacturing level.

2. Description of the Prior Art

Most deadbolt locks used in the average home are single cylinder locks having a key hole on the face of the lock located on the front side of the door and a latch on the opposite face side of the lock located on the back side of the door. Some of the deadbolt locks used in homes include a securing mechanism for preventing the latch from rotating from its locked position when the mechanism is engaged with the latch and some other object fixedly connected to the door.

U.S. Pat. No. 4,590,777 issued May 27, 1986 to Rafael Sierra discloses a bolt lock which can be immobilized in the locked position.

U.S. Pat. No. 999,127 issued Jul. 25, 1911 to Joseph S. Slivenick discloses a door latch in which a screw having a knurled head is used to engage the bolt of the door latch.

U.S. Pat. No. 5,052,202 issued Oct. 1, 1991 to Jerry A. Murphy discloses a deadbolt locking device having a head portion including an aperture for engaging the latch of a deadbolt in the locked position as two leg portions engage the door handle to prevent the latch from rotating the head portion.

U.S. Pat. No. 5,003,803 issued Apr. 2, 1991 to Robert M. Richards discloses a plate having an aperture therethrough for allowing the latch of a deadbolt to fit therein. Once the latch is turned to the locked position, the plate is fit over the backplate and attached thereto with the latch being located within said aperture, thereby preventing said latch from rotating.

U.S. Pat. No. 5,000,498 issued Mar. 19, 1990 to Lewis E. Upchurch discloses an adjustable clamp which can be fit over the latch and tightened down to securely clasp the latch. Once the latch is turned to its locked position, a sliding pin located at one end of the clamp can be slid into an aperture located on the door to prevent the latch from rotating.

U. K. Patent No. 1,564,607 issued Apr. 10, 1980 to Harry M. Williams discloses a fastener for immobilizing a door handle once in the closed position.

Swiss Patent No. 185,383 issued Oct. 1, 1936 to Wilh. Schulte discloses a deadbolt lock arrangement having a latch piece with an engaging member lockpost attached thereto for engaging the backplate once the latch is placed in its locked position.

None of the above inventions and patents, taken either singly or in combination, is seen to describe the instant invention as claimed.

SUMMARY OF THE INVENTION

The present invention primarily pertains to a kit for converting a conventional single cylinder deadbolt lock assembly having at least a key hole on one face side thereof and a backplate and turnpiece latch on an opposite face side thereof into a pick proof. The converted deadbolt lock assembly includes a locking shaft pin for preventing the turnpiece latch from rotating when the locking shaft pin is engaged by placing it through an aperture located through the latch and an aperture located through the backplate, wherein the aperture through the latch and backplate are coaxially aligned with one another. In this manner, a user at home can engage the locking shaft pin in order to prevent the latch from rotating, thereby preventing any would be intruder from unlocking the latch by picking the lock.

The kit of the present invention includes a locking shaft pin attached to a first end of a chain. A second end of the chain opposite the first end includes another fastener. This other fastener may be attached to the backplate of the deadbolt lock by simply unscrewing one of the screws thereof and inserting the screw through the other fastener before placing the screw back on the backplate. In this manner the locking shaft pin hangs down from the backplate through the use of the chain until it is ready to be used.

After the locking shaft pin is connected to the backplate, a user simply has to place the deadbolt lock in its locked position, e.g., extending the bolt of the lock to engage the door jamb, and then drilling a hole through the turnpiece latch and a hole through the backplate so that the two holes axially line up as the deadbolt is in its locked position. In the preferred embodiment, two collars are included in the kit to be place into the two drilled holes. In this manner, the locking shaft pin may be inserted into the apertures through the two collars so as to provide a proper fit of the locking shaft pin into the holes drilled through the turnpiece latch and backplate, thereby immobilizing the turnpiece latch so as to prevent any would be intruder from picking the deadbolt lock.

Accordingly, it is a principal object of the invention to provide a kit for converting a typical single cylinder deadbolt lock into a pick proof deadbolt lock while a user is at home.

It is another object of the invention to provide such a kit which can be easily installed into any conventional deadbolt lock assembly by the homeowner.

Still another object of the invention is to provide a pick proof mechanism for a deadbolt latch assembly which is simple to use and has few moving parts.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
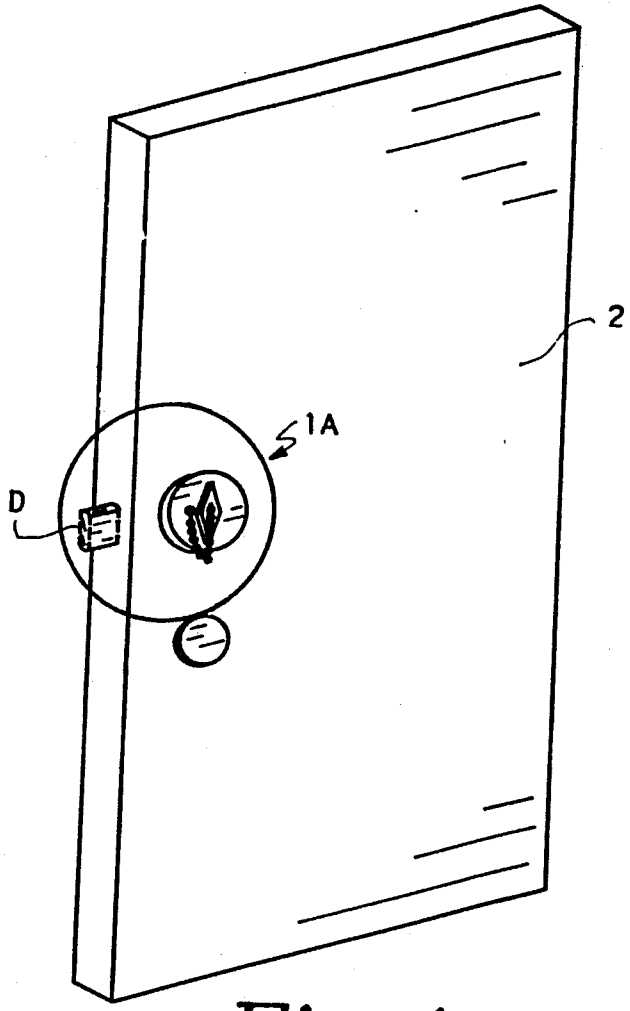
FIG. 1 is an environmental perspective view of the device of the present invention.
Figure 1A:
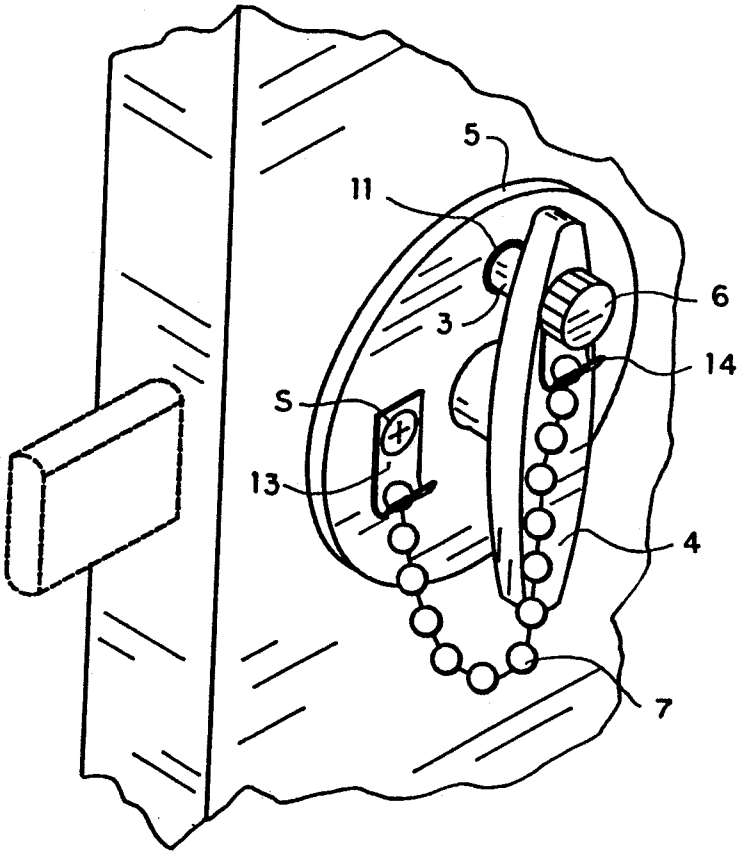
FIG. 1A is a fragmentary, enlarged scale view taken from the area 1A of FIG. 1.

FIG. 1 illustrates a conventional deadbolt lock mechanism 1 used on a door 2 and converted to be a pick proof lock mechanism after the kit of the present invention was employed therewith. As illustrated therein, a locking shaft pin 3 is placed into an orifice through the turnpiece latch 4 and the backplate 5 in order to prevent the deadbolt lock mechanism from being unlocked. The locking shaft pin 3 has a flanged head 6 at one end for allowing a user to grasp the pin 3 for easy removal from and placement into the orifices located through the turnpiece latch 4 and the backplate 5. While not in use, the locking shaft pin hangs down from a chain 7 connected to the backplate 5.

Figure 2:
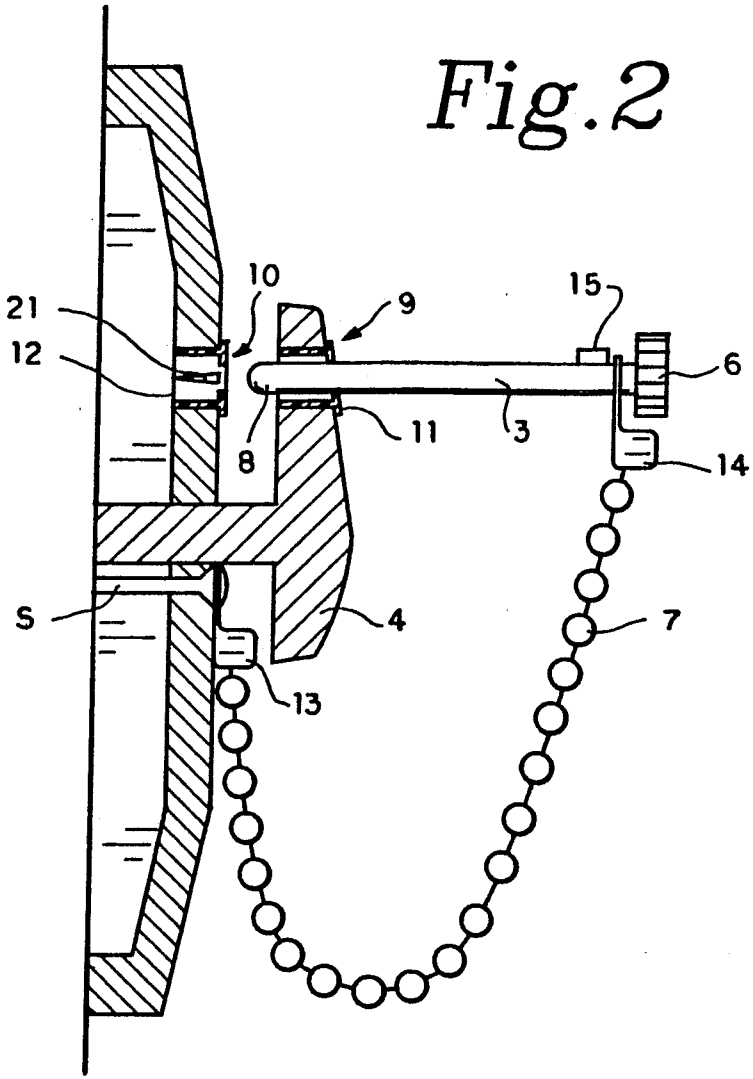
FIG. 2 is a cross-sectional view of the present invention with the locking shaft pin inserted within the aperture drilled through the turnpiece latch.

As illustrated in FIG. 2, the locking shaft pin 3 has a rounded end 8 opposite the end having the flanged head 6 attached thereto. With the deadbolt lock assembly 1 placed in its locked position in which a deadbolt D extends outward from the door 2, the user has only to slip the locking shaft pin 3 into a first orifice 9 drilled through the turnpiece latch 4 for engagement therewith and a second orifice 10 drilled through the backplate 5 for engagement therewith for preventing the turnpiece latch 4 from rotating as a key hole (not shown) located on the front side of the door 2 is operated.

In the preferred embodiment, two collars 11 and 12 are inserted into the orifices 9 and 10, respectively, for providing a snug fit about the locking shaft pin 3. Each of the collars 11 and 12 have an aperture therethrough having a diameter substantially equivalent to the diameter of the locking shaft pin 3. The outer diameter of each of the collars 11 and 12 is substantially equivalent to the diameter of the drilled orifices 9 and 10. In this manner, the locking shaft pin is maintained by a friction fit within the orifices 9 and 10 once inserted therein. The frictional fit is sufficient to prevent the locking shaft pin from slipping out of the orifices 9 and 10 due to vibrations, for example, caused by operating a key inside the key hole of the deadbolt lock mechanism 1. The frictional fit can not be so great as to prevent the locking shaft pin 3 from being manually removed from the orifices 9 and 10 in case of emergency.

As illustrated in FIGS. 1 and 2, the chain 7 is connected to the backplate 5 via a screw S of the deadbolt lock assembly 1 attaching a fastener 13 connected to one end of the chain 7. Connected to the other end of the chain 7, is another fastener 14 located around the locking shaft pin 3. A raised portion 15 prevents the fastener 14 from slipping off the locking shaft pin 3. The kit of the present invention includes the chain 7 attached to the locking shaft pin 3 and the fasteners 13 and 14 (see FIG. 4). The kit also includes the two collars 11 and 12. With a minimum amount of effort and required skill, the user can convert any conventional deadbolt lock assembly 1 into a pick proof lock following the procedures discussed below.

Figure 3:
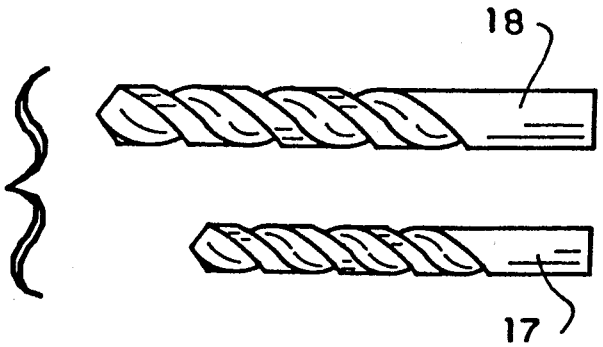
FIG. 3 illustrates the drill bits optionally used within the kit of the present invention.
Figure 4:
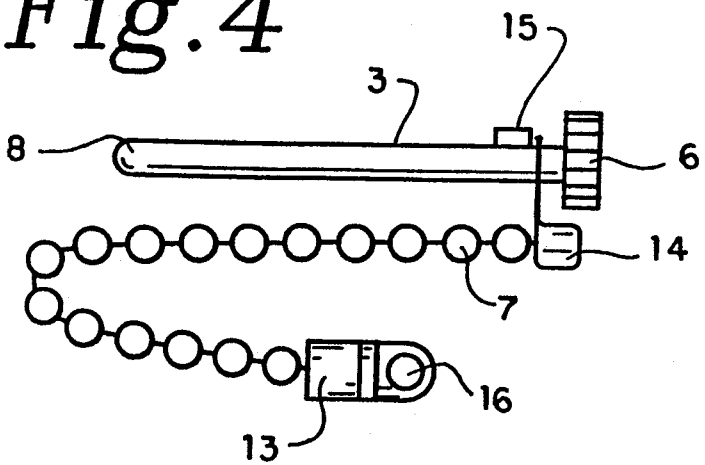
FIG. 4 is a side view of the locking shaft pin having the chain attached thereto.

As illustrated in FIG. 3, the kit of the present invention further may include one or more drill bits for the consumer. A kit for a locksmith would simply include the two collars 11 and 12 and the locking shaft pin 3 and attachments thereto as illustrated in FIG. 4. The procedure for installing the kit of the present invention into a deadbolt lock mechanism 1 would be the same. A screw S located on the backplate 5 would have to be unscrewed and inserted into an orifice 16 of the fastener before being reinserted into the backplate 5. After the turnpiece latch 4 is rotated so as to place the deadbolt lock mechanism 1 in its locked position, an orifice 9 is drilled through the turnpiece latch and another orifice 10 is drilled through the backplate 5. In the preferred embodiment, an initial orifice is drilled through the turnpiece latch 4 and the backplate 5 with a pilot drill bit 17 having a smaller diameter than the orifices 9 and 10. Afterwards, the larger drill bit 18 is used to drill the orifices 9 and 10. The orifices 9 and 10 are coaxially aligned with the initial orifices drilled through the turnpiece latch and backplate, as well as with each other.

Figure 6:
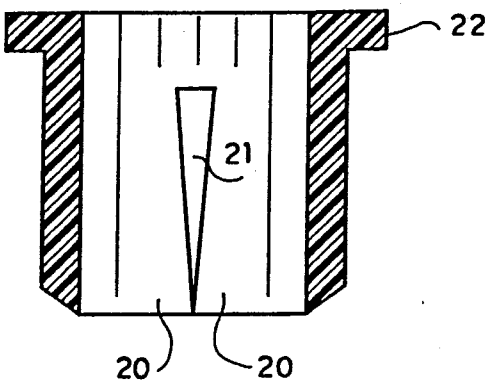
FIG. 6 is a cross-sectional view of the collar of FIG. 5 before it is expanded.
Figure 5:
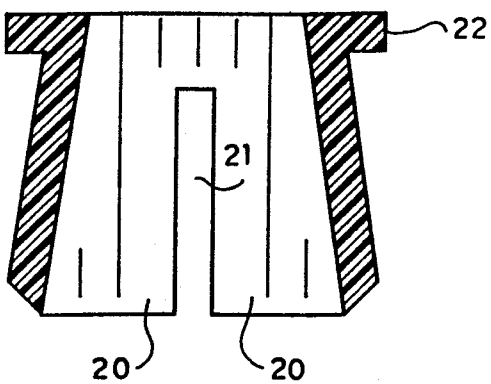
FIG. 5 is a cross-sectional view along lines 5—5 of the expanded collar as illustrated in FIG. 7.
Figure 7:
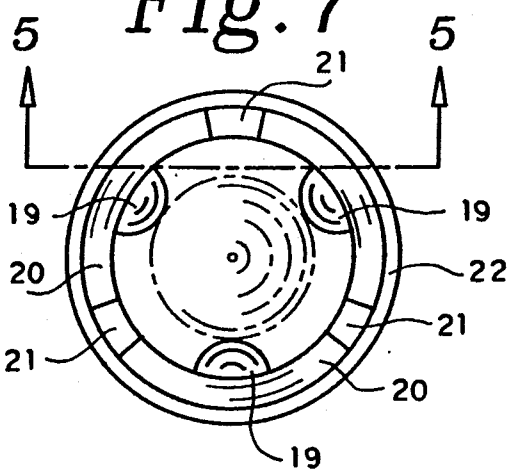
FIG. 7 is a bottom view of the collar after it is expanded by the locking shaft pin.

FIGS. 5–7 illustrate the details of the construction of the identically constructed collars 11 and 12. FIG. 7 illustrates a bottom view of the collar 11, the bottom view of the collar 12 being identical thereto. The collar 11 includes a plurality of nipples 19 extending inwardly into the aperture thereof from the front end thereof. As the locking shaft pin 3 is inserted therein, the nipples 19 engage the locking shaft to hold it in place. Initially the gap portions 21 are open as illustrated in FIG. 5. The collars 11 and 12 are inserted into the respective orifices 9 and 10 by squeezing on the collars so as to close the gaps 21.

Figure 8:
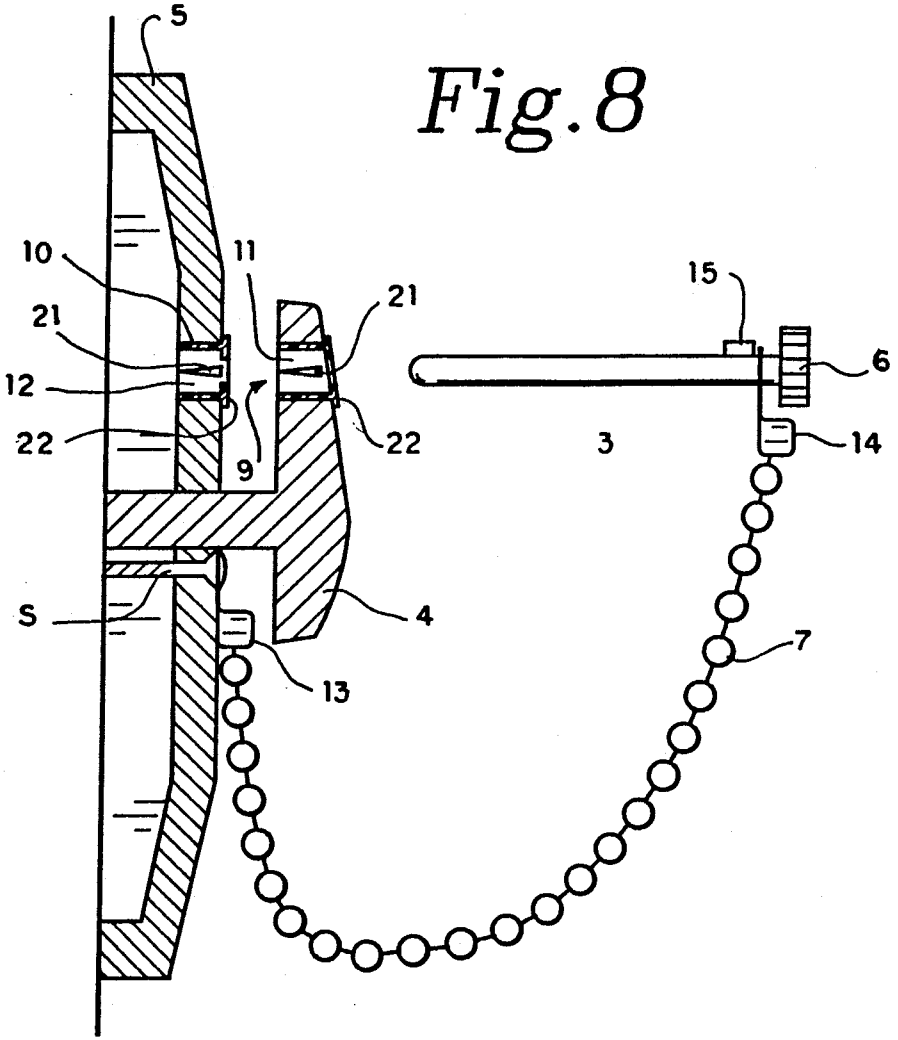
FIG. 8 is a cross-sectional view of a converted deadbolt lock before the locking shaft pin is inserted into the deadbolt latch and backplate.
Figure 9:
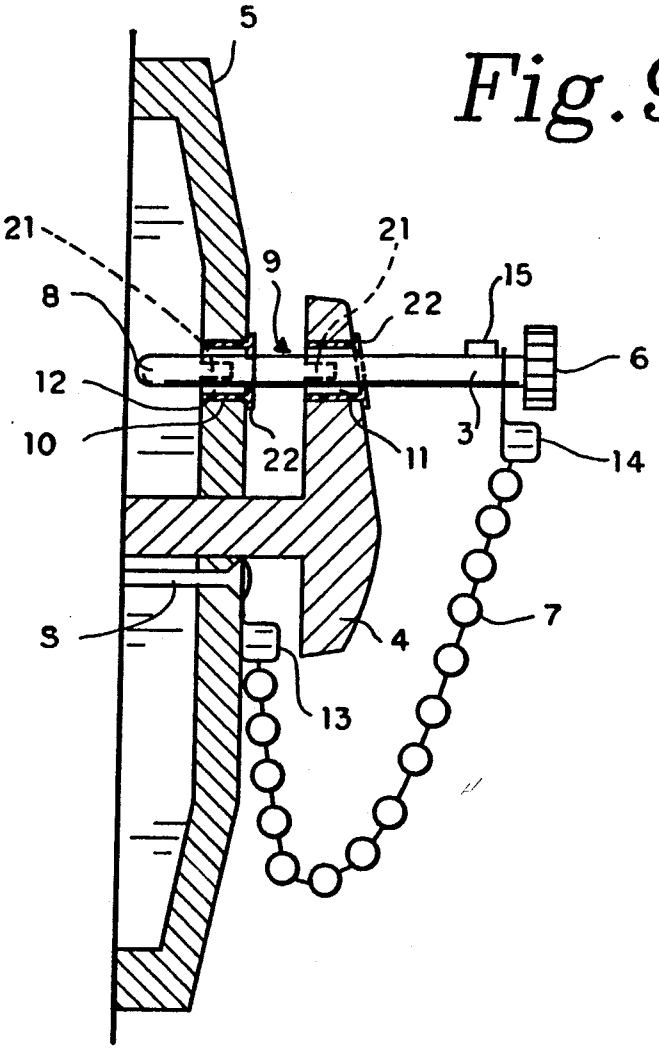
FIG. 9 is a view similar to FIG. 8, but showing a converted deadbolt lock after the locking shaft pin is inserted into the deadbolt latch and backplate.

As illustrated in FIGS. 5 and 6, the collar 11 also includes a rim portion 22 located over the front opening thereof. The collar 12 includes this same rim portion 22. As shown in FIG. 8, this rim portion 22 prevents the collars 11 and 12 from slipping out of their respective orifices 9 and 10. The gaps 21 of both collars 11 and 12 are initially open, as discussed above, before they are inserted into their respective orifices. As the locking shaft pin 3 is inserted into the apertures of the collars 11 and 12, it engages the nipples 19 to provide enough friction to prevent it from slipping out. However, the locking shaft pin 3, does not engage the inner walls of the collars 11 and 12 in a tight fit. This is important in case of emergency in which occupants must leave quickly, such as in the case of a fire. The locking shaft pin 3 must not become stuck inside the collars so that it can be pulled out quickly with ease. FIG. 9 illustrates the locking shaft pin 3 inserted into both of the collars 11 and 12. The locking shaft pin 3 is easily remove therefrom and has no engaging parts to get stuck therein.

It is to be understood that the present invention is not limited to the sole embodiment described above, but encompasses any and all embodiments within the scope of the following claims.

I claim:

1. A method of converting any conventional single cylinder deadbolt lock assembly having at least a key hole on a first face side thereof and a backplate and turnpiece latch on a second side thereof into a pick proof lock by preventing the turnpiece latch from turning once a locking shaft pin in engaged to connect the backplate and turnpiece latch, said method comprising the steps of:

attaching a chain having the locking shaft pin at a first end thereof to the backplate by securing a fastener attached at a second end thereof opposite the first end thereof to a screw located on the backplate;

placing a deadbolt lock of a conventional single cylinder deadbolt lock assembly in a locked position;

drilling a first engaging orifice of a predetermined diameter through the turnpiece latch after placing the deadbolt lock in a locked position;

drilling a second engaging orifice having the predetermined diameter as the first engaging orifice through the backplate after drilling the first engaging orifice through the turnpiece latch so that the first engaging orifice and the second engaging orifice are coaxially aligned;

inserting a first collar having an outer diameter substantially equivalent to the predetermined diameter into the first engaging orifice;

inserting a second collar having an outer diameter substantially equivalent to the predetermined diameter into the second engaging orifice;

wherein the locking shaft pin may be engaged to connect the turnpiece latch and the backplate by placing the locking shaft pin through a first aperture located through the first collar having a diameter substantially equivalent to the outer diameter of the locking shaft pin for providing a proper fit therethrough, and then placing said locking shaft pin through a second aperture located through the second collar also having a diameter substantially equivalent the outer diameter of the locking shaft pin, thus preventing said turnpiece latch from turning once the deadbolt lock is placed in the locked position.

2. A method of converting any conventional single cylinder deadbolt lock assembly into a pick proof lock as claimed in claim 1, further comprising the steps of:

drilling a first initial orifice through the turnpiece latch having a diameter less than the predetermined diameter after placing the deadbolt lock in the locked position and before drilling the first engaging orifice;

drilling a second initial orifice through the backplate having a diameter coaxially aligned with and the same size as the first initial orifice after drilling the first initial orifice and before drilling the first engaging orifice; and coaxially aligning the drilling of the first engaging orifice with the first initial orifice before drilling the first engaging orifice.

3. A conversion kit for converting a conventional single cylinder deadbolt lock assembly having at least a key hole on a first face side thereof and a backplate and turnpiece latch on a second side thereof, said conversion kit comprising:

a locking shaft pin having a rounded end at one end thereof and a flanged head at another end thereof, opposite said one end;

a chain having a first end and a second end;

a first fastener attached to said first end of said chain;

a second fastener attached to said second end of said chain and engaging said locking shaft pin proximate to said flanged head;

securing means preventing said second fastener from moving beyond a predetermined distance from said flanged head towards said rounded end; and, one for reception in each of the backplate and turnpiece latch, a plurality of collars, each one thereof having an aperture therethrough of substantially the same diameter as the diameter of the locking shaft pin.

4. A conversion kit for converting a conventional single cylinder deadbolt lock assembly as claimed in claim 3, further comprising a first drill bit having a diameter substantially the same as an outer diameter of each of said collars.

5. A conversion kit for converting a conventional single cylinder deadbolt lock assembly as claimed in claim 4, further comprising a second drill bit having a diameter less than the diameter of said first drill bit.

6. A conversion kit for converting a conventional single cylinder deadbolt lock assembly as claimed in claim 3 wherein said securing means includes a raised portion located on said locking shaft pin said predetermined distance from said flanged head towards said rounded end.

* * * * *